US006693394B1

(12) United States Patent
Guo et al.

(10) Patent No.: US 6,693,394 B1
(45) Date of Patent: Feb. 17, 2004

(54) BRIGHTNESS COMPENSATION FOR LED LIGHTING BASED ON AMBIENT TEMPERATURE

(75) Inventors: Sam Yonghong Guo, Canton, MI (US); Kenneth John Russel, Westland, MI (US)

(73) Assignee: Yazaki North America, Inc., Canton, MI (US)

( * ) Notice: Subject to any disclaimer, the term of this patent is extended or adjusted under 35 U.S.C. 154(b) by 25 days.

(21) Appl. No.: 10/056,763

(22) Filed: Jan. 25, 2002

(51) Int. Cl.[7] ..... H05B 41/36

(52) U.S. Cl. ..... 315/291; 315/158; 315/307; 315/309; 362/800; 323/369; 323/370

(58) Field of Search ..... 315/291, 134, 315/150, 155, 158, 157, 307, 309; 362/800; 323/364, 369, 370, 907

(56) References Cited

U.S. PATENT DOCUMENTS

| | | | | |
|---|---|---|---|---|
| 3,705,316 A | | 12/1972 | Burrous et al. | 327/513 |
| 3,986,186 A | | 10/1976 | Cochran | 345/46 |
| 4,346,590 A | | 8/1982 | Brown | 250/256 |
| 4,639,924 A | * | 1/1987 | Tsunekawa | 372/33 |
| 5,459,478 A | | 10/1995 | Bolger et al. | 345/46 |
| 5,493,101 A | | 2/1996 | Innes | 219/502 |
| 5,528,721 A | * | 6/1996 | Searcy et al. | 388/824 |
| 5,663,719 A | * | 9/1997 | Deese et al. | 340/912 |
| 5,783,909 A | | 7/1998 | Hochstein | 315/159 |
| 5,907,569 A | | 5/1999 | Glance et al. | 372/29.021 |
| 6,081,073 A | | 6/2000 | Salam | 315/169.2 |
| 6,111,739 A | | 8/2000 | Wu et al. | 361/106 |
| 6,127,784 A | | 10/2000 | Grossman | 315/159 |
| 6,313,589 B1 | * | 11/2001 | Kobayashi et al. | 315/309 |

* cited by examiner

*Primary Examiner*—Haissa Philogene
*Assistant Examiner*—Thuy Vinh Tran
(74) *Attorney, Agent, or Firm*—Rader, Fishman & Grauer PLLC

(57) ABSTRACT

A circuit regulates the flow of current to a bank of light emitting diodes (LEDs). The circuit is sensitive to ambient temperature and increases the voltage at the LEDs in the circuit. Consequently, the current flow to the LEDs will increase when the ambient temperature increases and the LEDs would, with a fixed current, begin to lose brightness. Consequently, the circuit allows LEDs to be used as lighting in applications, such as vehicle turn or brake signals, that experience wide ambient temperature variation but require that the LEDs remain sufficiently bright despite the temperature increases.

30 Claims, 3 Drawing Sheets

BRIGHTNESS COMPENSATION FOR LED LIGHTING BASED ON AMBIENT TEMPERATURE

FIELD OF THE INVENTION

This invention relates generally to the field of light emmitting diodes (LEDs). More specifically, the present invention addresses the change in brightness of LED lighting that can occur with changes in ambient temperature. The present invention provides a means for regulating the brightness of LEDs to automatically compensate for various ambient temperatures so that LEDs can be used in lighting applications that experience significant ambient temperature variation.

BACKGROUND OF THE INVENTION

Light Emitting Diodes (LEDs) are small colored lights that can be seen in or on electronic equipment, household appliances, toys, signs, and many other places. Red, yellow and green LEDs are common and have been around the longest. Other colors, like turquoise, blue, and pure-green are newer. Today's LEDs can be found in just about every color of the spectrum, including white. LEDs can also emit infrared and ultraviolet light beyond the visible spectrum.

LEDs are different from ordinary light bulbs in that they do not have a filament to break or burn out. They typically last 100,000 hours or more before they need to be replaced. They generate very little heat and require relatively little power. Consequently, LEDs are well suited for a wide variety of applications. The minimal power needs of LEDs make them ideal for use in battery-operated equipment like telephones, toys, and portable computers. The longevity of LEDs make them especially well suited for signage, Christmas lights and other forms of decorative lighting. Today, banks of LEDs are bright enough to illuminate an entire room and are no longer just a dim glow on a stereo.

Diodes generally are electronic circuit components that only allow current to flow in one direction. LEDs are diodes that have the "side effect" of producing light while electric current is flowing through them. In the simplest terms, an LED is made with two different kinds of semiconductor material: one type that has an excess of free electrons roaming around inside the material, and another that has a net positive charge and lacks electrons. When an electron from the first material, the donor, flows as a current across a thin barrier and into the second material, a photon or particle of light is produced.

The color of the light depends on a number of factors, including the type of material that the LED is made with and the material's quantum bandgap (i.e., how much energy each electron needs in order to cross the barrier). A smaller bandgap that fairly slow electrons can cross gives off infrared or red light, while a large bandgap that is crossed only by fast, high-energy electrons gives off light that has a blue or violet color to it.

The LED is a marvel of modern quantum physics, and LEDs are becoming much more commonly used in every type of application imaginable. The unique features of LEDs make them very attractive to many industries. However, one of the drawbacks of LED technology is that the brightness of an LED that is operated with a fixed current is greatly affected by the ambient temperature. For a circuit with a fixed current, a typical LED will shine brighter in colder temperatures and more dimly in hotter temperatures. This effect is charted in FIG. 1.

FIG. 1 illustrates typical luminous flux versus temperature for an HPWT-xH00 LED Emitter driven at a constant 60 mA of current. As shown in FIG. 1, the normalized light output (i.e., brightness) declines steadily as the ambient temperature rises. Specifically, as the temperature changes from −40° C. to 85° C., the normalized light output changes roughly from 1.74 to 0.52. In other words, when the temperature increases from −40° C. to 85° C., the brightness decreases by a factor of 3.3.

To illustrate the problem, consider the automobile industry. LEDs are becoming much more widely used in vehicle signal lighting, such as for turning signal lights, stop lights, tail lights, etc. During the night when there is very little light, a turn signal with relatively low brightness may be adequate due to the low light levels. In other words, it is easier to see an LED or any other light at night when little ambient light is present. However, the LEDs that make up a turn signal will likely be relatively brighter at night due to a low ambient nighttime temperature.

On the contrary, during a hot summer day at noon, strong sunlight shoots directly into and around an LED assembly. Consequently, a strong brightness is required for the LED assembly to be visible in spite of the bright ambient glare of the sunlight. Unfortunately, the LEDs may be dimmest under those conditions due to the high ambient temperature.

Consequently, there is a need in the art for a means and method of compensating for the effects of ambient temperature on the brightness of LED lighting so that LED lighting can be effectively used in automobile and other applications that may experience a significant variation in ambient temperature.

SUMMARY OF THE INVENTION

The present invention meets the above-described needs and others. Specifically, the present invention provides a means and method of compensating for the effects of temperature on the brightness of LED lighting so that LED lighting can be effectively used in applications that may experience a significant variation in ambient temperature.

Additional advantages and novel features of the invention will be set forth in the description which follows or may be learned by those skilled in the art through reading these materials or practicing the invention. The advantages of the invention may be achieved through the means recited in the attached claims.

The present invention may be embodied and described as a current regulating circuit for connection between a power supply and one or more light-emitting diodes (LEDs). The circuit includes a temperature-sensitive element that responds to ambient temperature; and a regulator, connected to the temperature-sensitive element, for regulating current flow to the LEDs in response to output from the temperature-sensitive element. The current regulating circuit is configured to provide more current to the LEDs when ambient temperature rises and less current to the LEDs when ambient temperature drops so as to compensate for variations in LED brightness that naturally accompany ambient temperature change.

The regulator may be a voltage regulator that is configured to regulate a voltage difference between the power supply and the LEDs. The voltage regulator may regulate the voltage difference in response to a resistance load connected between ground and the voltage regulator. The resistance load may include the temperature-sensitive element. In such as case, the temperature-sensitive element is preferably a positive temperature coefficient component connected to the voltage regulator. The positive temperature coefficient component may be, for example, a thermistor or a silistor with a resistance that varies with ambient temperature.

The resistance load may also include a resistor for adjusting the compensation depth of the current regulating circuit. The resistor may be connected in parallel or in series with the positive temperature coefficient component.

Alternatively, the regulator may be a voltage regulator that is configured to regulate a voltage difference between the power supply and the LEDs in response to a signal applied to an adjustment terminal of the voltage regulator, the temperature-sensitive element being connected to the adjustment terminal. In this embodiment, the temperature-sensitive element may be a diode. The diode is connected between the output of the voltage regulator and the adjustment terminal of the voltage regulator. This circuit may also include a voltage divider connected to the diode and the adjustment terminal of the voltage regulator for adjusting the voltage applied to the adjustment terminal of the voltage regulator by the diode.

The present invention also encompasses the methods inherent in making and operating the circuits described above and similar circuits. For example, the present invention encompasses a method of regulating current flow between a power supply and one or more light-emitting diodes (LEDs) to compensate for variations in LED brightness that accompany ambient temperature change by: sensing ambient temperature; and regulating current flow from the power supply to the LEDs in response to the ambient temperature. As before, more current is provided to the LEDs when ambient temperature rises and less current is provided to the LEDs when ambient temperature drops to compensate for variations in LED brightness that accompany ambient temperature change.

BRIEF DESCRIPTION OF THE DRAWINGS

The accompanying drawings illustrate preferred embodiments of the present invention and are a part of the specification. Together with the following description, the drawings demonstrate and explain the principles of the present invention. The illustrated embodiments are examples of the present invention and do not limit the scope of the invention.

Throughout the drawings, identical elements are designated by identical reference numbers.

DETAILED DESCRIPTION OF THE PREFERRED EMBODIMENTS

The present invention provides, among other things, several circuit designs that regulate the flow of current to one or more light emitting diodes (LEDs). The circuits of the present invention include a temperature-sensitive element that is sensitive to ambient temperature and increases the current flow to the LEDs or the voltage difference in the circuit and, consequently, the current flow to the LEDs when the ambient temperature increases. With an increase in ambient temperature, the LEDs, if driven with a fixed current, begin to lose brightness. By increasing the current in response to an elevated ambient temperature, the circuits of the present invention maintain the brightness of the LEDs. Consequently, the circuits of the present invention allow LEDs to be used as lighting in applications, such as in vehicle turn or brake signals, that experience wide ambient temperature variation but require that the LEDs remain sufficiently bright despite the temperature changes.

Figure 1:
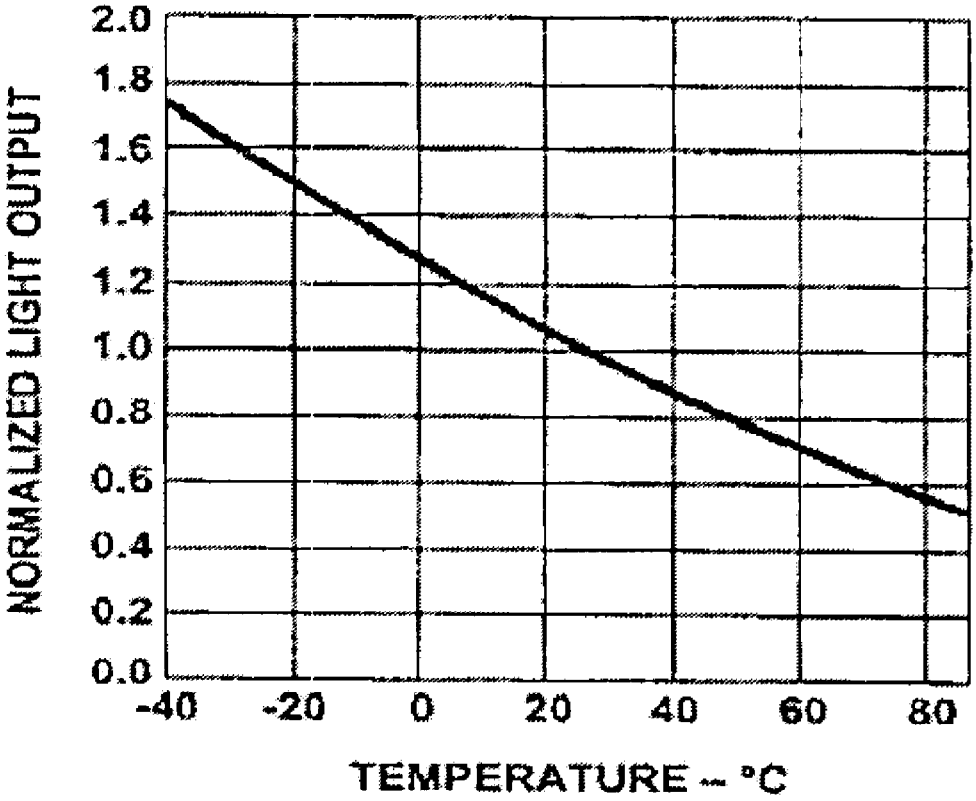
FIG. 1 is a linear scale graph illustrating the effect of temperature variation on LED lighting driven at a fixed current.
Figure 2A:
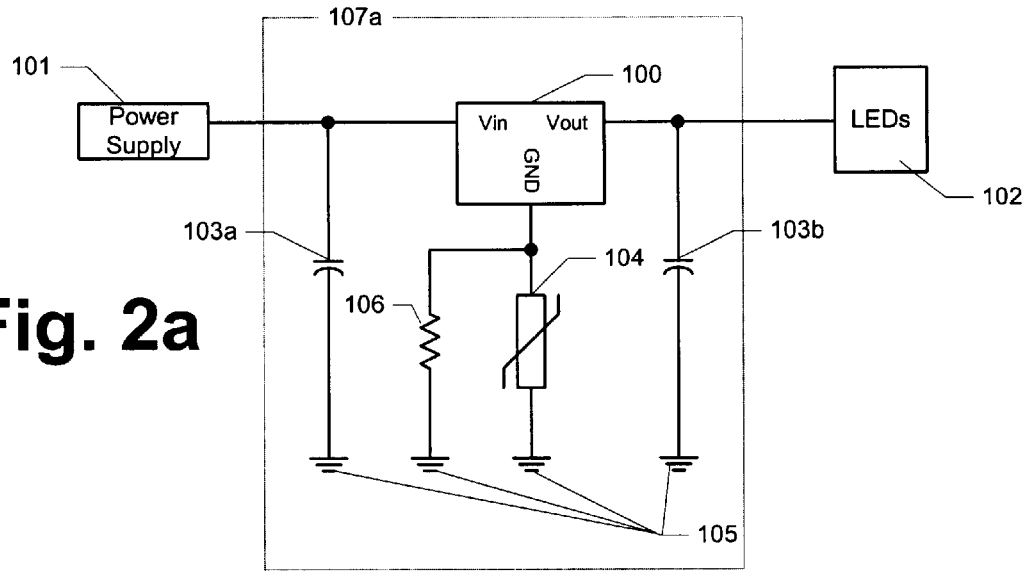
FIG. 2*a* is a circuit diagram of a circuit according to a first embodiment of the present invention for dynamically adjusting the brightness of LED lighting in response to ambient temperature.

FIG. 2*a* is a diagram of a circuit according to a first embodiment of the present invention. The circuit of FIG. 2*a* dynamically adjusts the current applied to an LED light source to maintain the brightness of the LED lighting despite changes in ambient temperature. As shown in FIG. 2*a*, a compensation circuit (107*a*) is connected between a power source (101) and one or more LEDs (102). In many applications, the LEDs (102) would be an array or bank of LEDs arranged together to provide lighting for a specific purpose, for example, as a turn or brake signal on an automobile.

This compensation circuit (107*a*) and the other compensation circuits disclosed herein may also be referred to as voltage regulators and current compensators. The purpose of the compensation circuit (107*a*) is to regulate the power supply voltage to output a constant voltage for LEDs (102) at a fixed temperature. As described above, an elevated temperature will cause an LED to produce less light than a colder temperature if the current to the LED is constant. Consequently, as temperature increases, LEDs tend to dim.

The compensation circuit (107*a*) is also sensitive to ambient temperature. As the temperature rises and the LEDs (102) tend to produce less light, the compensation circuit (107*a*) increases the flow of current from the power supply (101) to the LEDs (102). This may be done by increasing the output voltage of circuit (107*a*). In any event, the increased current will cause the LEDs (102) to emit more light and become brighter despite the elevation in temperature. Thus, the brightness of the LEDs (102) can be kept relatively constant by regulating the current applied to the LEDs (102) in response to ambient temperature.

As shown in FIG. 2*a*, the compensation circuit (107*a*) includes a fixed-voltage, linear-voltage regulator (100). The voltage regulator (100) is connected between the power supply (101) and the LEDs (102). To the left of the regulator (100), a capacitor (103*a*) is connected between ground (105) and the connection between the power supply (101) and the voltage regulator (100). To the right of the regulator (100), a second capacitor (103*b*) is connected between ground (105) and the connection between the voltage regulator (100) and the LEDs (102).

The voltage regulator (100) regulates the input power supply voltage. It guarantees a fixed voltage applied to the LEDs at a fixed temperature. For example, when the power supply voltage (101) changes from eight volts to sixteen volts, the LEDs always get a constant voltage at $V_{out}$ such as five volts, thus the LEDs will have a constant current independent of the power supply voltage at a fixed temperature. When temperature increases, $V_{out}$ will be increased to another fixed value such as five-point-four volts according to the temperature. This five-point-four volts will still be fixed whether the power supply voltage is eight volts or sixteen volts.

The voltage regulator (100) is also connected to ground (105) through a resistance path (106, 104). A connection is made to a ground terminal (GND) of the voltage regulator (100), through the resistance path (106, 104), to ground (105), as shown in FIG. 2*a*. The amount of resistance provided by the resistance path (106, 104) determines the voltage difference created by the voltage regulator between its $V_{in}$ terminal, connected to the power supply (101), and its $V_{out}$ terminal, connected to the LEDs (102). The resistance of the path (106, 104) determines, in part, the voltage at the ground terminal (GND) of the voltage regulator (100).

The resistance path illustrated in FIG. 2*a* is made up of a resistor (106) connected between the voltage regulator (100) and ground (105) in parallel with a positive temperature coefficient component (104). The positive temperature coefficient component (104) is sensitive to ambient temperature. In fact, the resistance of the positive temperature coefficient component (104) varies with ambient temperature such that the resistance of the positive temperature coefficient component (104) increases as the ambient temperature increases.

Consequently, as the ambient temperature increases and the resistance of the positive temperature coefficient component (104) increases, the total resistance of the path (106, 104) connected to the ground terminal (GND) of the voltage regulator (100) increases. As noted above, this causes the voltage regulator (100) to increase the voltage at the $V_{out}$ terminal, thereby increasing the flow of current between the power source (101) and the LEDs (102). Thus, the brightness of the LEDs (102) is compensated by an increased current when the ambient temperature rises.

The resistor (106) is selected based on the characteristics of the voltage regulator (100). The resistor (106) provides a constant resistance to which the resistance of the positive temperature coefficient component (104) is added. The resistance of the resistor (106) is selected so that the additional variation in resistance provided by the positive temperature coefficient component (104) over the expected range of ambient temperatures will correspond to the range of total resistance that should be applied to the voltage regulator (100) to obtain desired voltage at the LEDs (102) so that the brightness of the LEDs (102) is maintained or increased by increased current during periods of elevated ambient temperature. In other words, the resistance of the resistor (106) is used to adjust the compensation depth of the circuit (107*a*).

The positive temperature coefficient component (104) may be, for example, a thermistor or a thermally sensitive silicon resistor, sometimes referred to as a "silistor." Positive temperature coefficient thermistors may be made of polycrystalline ceramic materials that are normally highly resistive but are made semiconductive by the addition of dopants. They are most often manufactured using compositions of barium, lead and strontium titanates with additives such as yttrium, manganese, tantalum and silica. Silistors are similarly constructed and operate on the same principles. However, silistors employ silicon as the semiconductive component material.

Thermistors and silistors exhibit a fairly uniform positive temperature coefficient (about +0.77%/° C.) through most of their operational range and at most temperatures that would be of concern in practicing the present invention. It may be noted that at extreme temperatures, thermistors and silistors can exhibit a negative temperature coefficient. For example, these devices may have a resistance-temperature characteristic that exhibits a very small negative temperature coefficient at very low temperatures. This is true until the device reaches a critical minimum temperature that is referred to as its "Curie," switch or transition temperature. Beyond the critical transition temperature, the devices begin to exhibit a rising, positive temperature coefficient of resistance as well as a large increase in resistance. Thermistors and silistor can also exhibit a negative temperature coefficient region at temperatures in excess of 150° C. However, as noted, these extreme temperatures have little or no impact on the applications contemplated by the present invention.

Figure 2B:
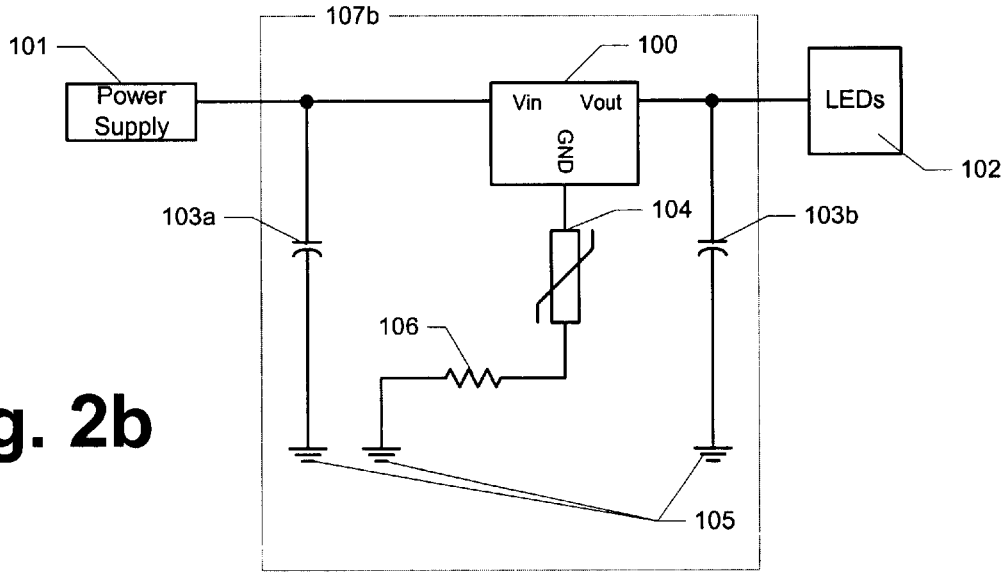
FIG. 2*b* is also a circuit diagram of a circuit according to the first embodiment of the present invention for dynamically adjusting the brightness of LED lighting in response to ambient temperature. The circuit in FIG. 2*b* is a variation of the circuit illustrated in FIG. 2*a*.

FIG. 2*b* is also a circuit diagram of a circuit according to the first embodiment of the present invention for dynamically adjusting the brightness of LED lighting in response to ambient temperature. The circuit in FIG. 2*b* is a variation of the circuit illustrated in FIG. 2*a*. A redundant explanation of similar components will be omitted.

As shown in FIG. 2*b*, the resistor (106) may be connected in series with the positive temperature coefficient component (104) between ground (105) and the voltage regulator (100). Generally, two resistive elements (e.g., 104, 106) connected in parallel provide less total or equivalent resistance than two identical resistive elements connected in series. Consequently, the resistance of the resistor (106) would have to be increased over that used in the embodiment of FIG. 2*a* for the two embodiments to have the same compensation depth and range. However, the embodiment illustrated in FIG. 2*b* is a viable alternative circuit configuration for implementing the present invention. Other such variations will be apparent to those skilled in the art with the benefit of this specification.

In FIG. 2*b*, as before, the positive temperature coefficient component (104) provides a response to ambient temperature. As the ambient temperature increases, the resistance of the positive temperature coefficient component (104) increases. As the total resistance of the path (106, 104) connected to the ground terminal (GND) of the voltage regulator (100) increases, the voltage regulator (100) increases the voltage at the $V_{out}$ terminal, thereby increasing the flow of current between the power source (101) and the LEDs (102). Thus, the brightness of the LEDs (102) is maintained or increased as desired by an increased current when the ambient temperature rises.

Figure 3A:
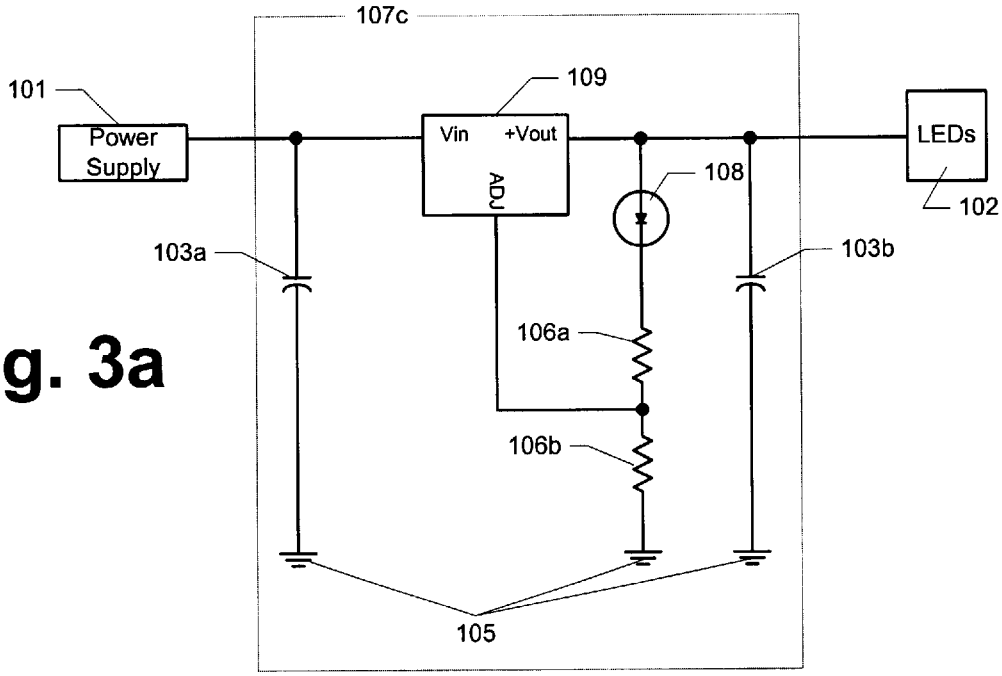
FIG. 3*a* is a circuit diagram of a circuit according to a second embodiment of the present invention for dynamically adjusting the brightness of LED lighting in response to ambient temperature.

FIG. 3*a* is a circuit diagram of a circuit according to a second embodiment of the present invention for dynamically adjusting the brightness of LED lighting in response to ambient temperature. As shown in FIG. 3*a*, a current regulating or compensation circuit (107*c*) is connected between a power source (101) and one or more LEDs (102). As before, in many applications, the LEDs (102) would be an array or bank of LEDs arranged together to provide lighting for a specific purpose. Such a purpose may be, for example, as a turn or brake signal on an automobile.

As before, the purpose of the compensation circuit (107*c*) is to regulate the flow of current or the voltage difference between the power source (101) and the LEDs (102). As described above, an elevated temperature will cause an LED to produce less light than at a colder temperature if the current to the LED is constant. Consequently, as temperature increases, LEDs tend to dim.

The compensation circuit (107*c*) is sensitive to ambient temperature. As the temperature rises and the LEDs (102)

tend to produce less light, the compensation circuit (107*c*) increases the flow of current from the power supply (101) to the LEDs (102). This may be done by increasing the voltage at the LEDs (102). The increased current will cause the LEDs (102) to emit more light and become brighter despite the elevation in temperature. Thus, the brightness of the LEDs (102) can be kept relatively constant by regulating the current applied to the LEDs (102) in response to ambient temperature.

As shown in FIG. 3*a*, the compensation circuit (107*c*) includes a variable voltage, linear-voltage regulator (109). The voltage regulator (109) is connected between the power supply (101) and the LEDs (102). To the left of the regulator (109), a capacitor (103*a*) is connected between ground (105) and the connection between the power supply (101) and the voltage regulator (109). To the right of the regulator (109), a second capacitor (103*b*) is connected between ground (105) and the connection between the voltage regulator (109) and the LEDs (102).

The voltage regulator (109) regulates the input power supply voltage. It guarantees a fixed voltage applied to the LEDs at a fixed temperature. For example, when the power supply voltage (101) changes from eight volts to sixteen volts, the LEDs always get a constant voltage at $V_{out}$ such as five volts, thus the LEDs will have a constant current independent of the power supply voltage at a fixed temperature. When temperature increases, $V_{out}$ will be increased to another fixed value such as five-point-four volts according to the temperature. This five-point-four volts will still be fixed whether the power supply voltage is eight volts or sixteen volts.

The voltage regulator (109) has an adjustment terminal (ADJ). The signal applied to the adjustment terminal (ADJ) controls the voltage at the $+V_{out}$ terminal. The output of the voltage regulator (109) is connected through a diode (108) and a resistor (106*a*) to the adjustment terminal (ADJ) of the regulator (109).

In the compensation circuit (107*c*), the diode (108) is the temperature sensitive component. Diodes only allow current to flow in one direction. In the simplest terms, a diode is made with two different kinds of semiconductor material: one type that has an excess of free electrons roaming around inside the material (N), and another that has a net positive charge and lacks electrons (P). The electrical property of the PN barrier is dependent on ambient temperature. For example, as the temperature increases the voltage across the PN junction decreases. This voltage drop affects the voltage at the adjustment terminal (ADJ) of the voltage regulator (109).

Consequently, as the ambient temperature increases, the voltage across the diode (108) decreases, affecting the signal applied to the adjustment terminal (ADJ) of the regulator (109). Consequently, the voltage regulator (109) increases the voltage at the $+V_{out}$ terminal, thereby increasing the flow of current between the power source (101) and the LEDs (102). Thus, the brightness of the LEDs (102) is maintained or increased as desired by an increased current when the ambient temperature rises. Conversely, as temperature decreases, the voltage difference across the diode (108) increases, the voltage at $+V_{out}$ decreases and less current flows from the power supply (101) to the LEDs (102).

The diode (108) is connected between $+V_{out}$ and the (ADJ) through the resistor (106*a*). The adjustment terminal (ADJ) is connected to ground (105) through the resistor (106*b*).

The two resistors (106*a*, 106*b*) function as a voltage divider. The resistors (106*a*, 106*b*) are selected to set $+V_{out}$ at normal temperature and to adjust the compensation depth of the compensation circuit (107*c*).

Figure 3B:
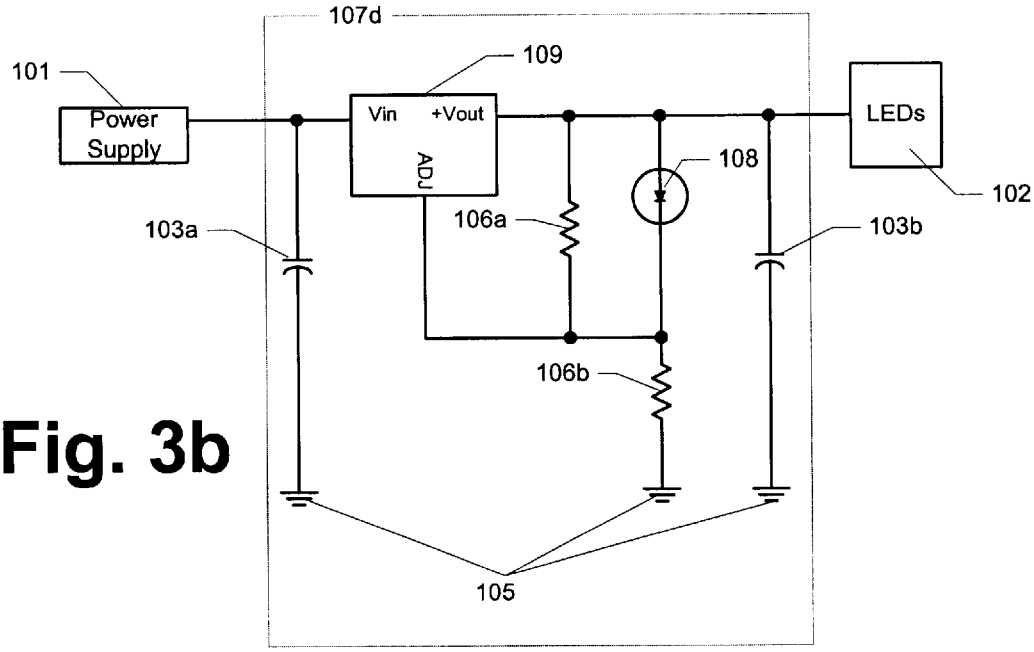
FIG. 3*b* is also a circuit diagram of a circuit according to the second embodiment of the present invention for dynamically adjusting the brightness of LED lighting in response to ambient temperature. The circuit in FIG. 3*b* is a variation of the circuit illustrated in FIG. 3*a*.

FIG. 3*b* is also a circuit diagram of a circuit according to the second embodiment of the present invention for dynamically adjusting the brightness of LED lighting in response to ambient temperature. The circuit in FIG. 3*b* is a variation of the circuit illustrated in FIG. 3*a*, and shares many similar elements with the circuit described above in connection with FIG. 3*a*. A redundant description of similar elements will be omitted.

As shown in FIG. 3*b*, a compensation circuit (107*d*) is again provided between the power supply (101) and the LEDs (102) to compensate the current provided to the LEDs (102) in response to varying ambient temperatures. FIG. 3*b* also illustrates that the voltage divider, i.e., the resistors (106*a*, 106*b*), can be connected in alternate configurations.

In FIG. 3*b*, the diode (108) is still connected to the adjustment terminal (ADJ) of the voltage regulator (109). A first resistor (106*a*) is connected between the anode and cathode of the diode and between the adjustment terminal (ADJ) and the $+V_{out}$ terminal of the voltage regulator (109). The second resistor (106*b*) is connected between the adjustment terminal (ADJ) and ground (105). The second resistor (106*b*) is also connected in series with the first resistor (106*a*) between the $+V_{out}$ terminal of the voltage regulator (109) and ground (I 05).

The two resistors (106*a*, 106*b*) function as a voltage divider. They are selected to set $+V_{out}$ at normal temperature and to adjust the compensation depth of the compensation circuit (107*d*).

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A current regulating circuit for connection between a power supply and one or more light-emitting diodes (LEDs), said circuit comprising:

a voltage regulator for regulating current flow to the LEDs; and a resistance load that varies in response to ambient temperature, wherein said voltage regulator is connected to ground through said resistance load;

wherein said voltage regulator is configured to regulate a voltage difference between said power supply and said LEDs, said voltage regulator regulating said voltage difference in response to said resistance load, said resistance load varying in response to ambient temperature; and wherein said voltage regulator is configured to provide more current to said LEDs when ambient temperature rises and less current to said LEDs when ambient temperature drops to compensate for variations in LED brightness that accompany ambient temperature change.

2. The circuit of claim 1, wherein said resistance load comprises a temperature-sensitive element that varies resistance in response to ambient temperature.

3. The circuit of claim 2, wherein said resistance load further comprises a resistor for adjusting a compensation depth of said temperature-sensitive element.

4. The circuit of claim 3, wherein said temperature-sensitive element is connected in parallel with said resistor.

5. The circuit of claim 3, wherein said temperature-sensitive element is connected in series with said resistor.

6. The circuit of claim 2, wherein said temperature-sensitive element is a thermistor.

7. The circuit of claim 2, wherein said temperature-sensitive element is a silistor.

8. A current regulating circuit for connection between a power supply and one or more light-emitting dinodes (LEDs), said circuit comprising:

temperature-sensitive element that responds to ambient temperature; and a regulator, connected to said temperature-sensitive element, for regulating current flow to the LEDs in response to output from said temperature-sensitive element;

wherein said current regulating circuit is configured to provide more current to said LEDs when ambient temperature rises and less current to said LEDs when ambient temperature drops to compensate for variations in LED brightness that accompany ambient temperature change, wherein said regulator is a voltage regulator that is configured to regulate a voltage difference between said power supply and said LEDs, said voltage regulator regulating said voltage difference in response to a resistance load connected between ground and said voltage regulator; and wherein said resistance load comprises said temperature-sensitive element which is a positive temperature coefficient component connected to said voltage regulator.

9. The circuit of claim 8, wherein said positive temperature coefficient component is a thermistor.

10. The circuit of claim 8, wherein said positive temperature coefficient component is a silistor.

11. The circuit of claim 8, wherein said resistance load further comprises a resistor for adjusting a compensation depth of said current regulating circuit, said resistor being connected in parallel with said positive temperature coefficient component.

12. The circuit of claim 8, wherein said resistance load further comprises a resistor for adjusting a compensation depth of said current regulating circuit, said resistor being connected in series with said positive temperature coefficient component.

13. A current regulating circuit for connection between a power supply and one or more light-emitting diodes (LEDs), said circuit comprising:

a temperature-sensitive element that responds to ambient temperature, wherein said temperature-sensitive element does not comprise a thermistor; and a regulator, connected to said temperature-sensitive element, for regulating current flow to the LEDs in response to output from said temperature-sensitive element;

wherein said current regulating circuit is configured to provide more current to said LEDs when ambient temperature rises and less current to said LEDs when ambient temperature drops to compensate for variations in LED brightness that accompany ambient temperature change, wherein said regulator is a voltage regulator that is configured to regulate a voltage difference between said power supply and said LEDs, said voltage regulator regulating said voltage difference in response to a signal applied to an adjustment terminal of said voltage regulator, said temperature-sensitive element being connected to said adjustment terminal.

14. The circuit of claim 13, wherein said temperature-sensitive element is a diode.

15. The circuit of claim 14, wherein said diode is connected between an output of said voltage regulator and said adjustment terminal of said voltage regulator.

16. The circuit of claim 15, further comprising a voltage divider connected to said diode and said adjustment terminal of said voltage regulator for adjusting a voltage applied to said adjustment terminal of said voltage regulator by said diode.

17. A method of regulating current flow between a power supply and one or more light-emitting diodes (LEDs) to compensate for variations in LED brightness that accompany ambient temperature change, said method comprising:

regulating current flow from said power supply to said LEDs by regulating a voltage difference between said power supply and said LEDs in response to a resistance load that varies with said ambient temperature;

wherein more current is provided to said LEDs when ambient temperature rises and less current is provided to said LEDs when ambient temperature drops to compensate for variations in LED brightness that accompany ambient temperature change.

18. The method of claim 17, wherein said regulating a voltage difference further comprises responding with a voltage regulator to said resistance load that varies with ambient temperature, wherein said resistance load is connected to said voltage regulator.

19. The method of claim 18, wherein said regulating a voltage difference further comprises connecting a positive temperature coefficient component between ground and said voltage regulator as part of said resistance load.

20. The method of claim 15, further comprising connecting a thermistor between ground and said voltage regulator as said positive temperature coefficient component.

21. The method of claim 19, further comprising connecting a silistor between ground and said voltage regulator as said positive temperature coefficient component.

22. The method of claim 19, wherein said regulating a voltage difference further comprises connecting a resistor as part of said resistance load between ground and said voltage regulator in parallel with said positive temperature coefficient component.

23. The method of claim 19, wherein said regulating a voltage difference further comprises connecting a resistor as part of said resistance load between ground and said voltage regulator in series with said positive temperature coefficient component.

24. A circuit for regulating current flow between a power supply and one or more light-emitting diodes (LEDs) to compensate for variations in LED brightness that accompany ambient temperature change, said circuit comprising:

means sensitive to ambient temperature that control a variable resistance load in response to ambient temperature; and means for regulating current flow from said power supply to said LEDs in response to said variable resistance;

wherein more current is provided to said LEDs when ambient temperature rises and less current is provided to said LEDs when ambient temperature drops to compensate for variations in LED brightness that accompany ambient temperature change.

25. The circuit of claim 24, wherein said means for regulating current flow comprise means for regulating a voltage difference between said power supply and said LEDs.

26. The circuit of claim 25, wherein said means for regulating a voltage difference comprise a voltage regulator and said means sensitive to ambient temperature comprise a positive temperature coefficient component having a resistance that varies in response ambient temperature, said positive temperature coefficient component being connected to said voltage regulator, said voltage regulator regulating said voltage difference in response to said variable resistance load that includes said positive temperature coefficient component.

27. The circuit of claim 26, wherein said positive temperature coefficient component comprises a thermistor.

28. The circuit of claim 26, wherein said positive temperature coefficient component comprises a silistor.

29. The circuit of claim 26, wherein said resistance load further comprises a resistor connected between ground and said voltage regulator in parallel with said positive temperature coefficient component.

30. The circuit of claim 26, wherein said resistance load further comprises a resistor connected between ground and said voltage regulator in series with said positive temperature coefficient component.

* * * * *

UNITED STATES PATENT AND TRADEMARK OFFICE

CERTIFICATE OF CORRECTION

PATENT NO. : 6,693,394 B1
DATED : February 17, 2004
INVENTOR(S) : Sam Y. Guo et al.

It is certified that error appears in the above-identified patent and that said Letters Patent is hereby corrected as shown below:

Column 10,
Line 23, delete "said"
Line 38, for the claim reference numeral "15", should read -- 19 --.

Signed and Sealed this

Eighteenth Day of May, 2004

JON W. DUDAS
*Acting Director of the United States Patent and Trademark Office*